US008884835B2

(12) United States Patent
Pelosi et al.

(10) Patent No.: US 8,884,835 B2
(45) Date of Patent: Nov. 11, 2014

(54) ANTENNA SYSTEM, METHOD AND MOBILE COMMUNICATION DEVICE

(75) Inventors: Mauro Pelosi, Aalborg (DK); Alexandru Daniel Tatomirescu, Aalborg (DK); Mikael Bergholz Knudsen, Gistrup (DK); Gert F. Pedersen, Storvorde (DK); Osama Nafeth Alrabadi, Aalborg (DK); Samantha Caporal Del Barrio, Aalborg (DK); Poul Olesen, Stovring (DK); Peter Bundgaard, Aalborg (DK)

(73) Assignee: Intel Mobile Communications GmbH, Neubiberg (DE)

( * ) Notice: Subject to any disclaimer, the term of this patent is extended or adjusted under 35 U.S.C. 154(b) by 202 days.

(21) Appl. No.: 13/570,327

(22) Filed: Aug. 9, 2012

(65) Prior Publication Data

US 2014/0043201 A1 Feb. 13, 2014

(51) Int. Cl.
*H01Q 1/48* (2006.01)
*H01Q 1/24* (2006.01)

(52) U.S. Cl.
USPC ..... 343/848; 343/702; 343/846

(58) Field of Classification Search
USPC ..... 343/702, 846, 848, 767, 745, 746
See application file for complete search history.

(56) References Cited

U.S. PATENT DOCUMENTS

| | | | | |
|---|---|---|---|---|
| 6,624,789 | B1 * | 9/2003 | Kangasvieri et al. | 343/702 |
| 6,864,848 | B2 * | 3/2005 | Sievenpiper | 343/767 |
| 6,917,337 | B2 * | 7/2005 | Iida et al. | 343/702 |
| 8,552,913 | B2 * | 10/2013 | Ayatollahi et al. | 343/702 |
| 8,643,558 | B2 * | 2/2014 | Tseng et al. | 343/750 |
| 2013/0300625 | A1 * | 11/2013 | Wong et al. | 343/848 |

FOREIGN PATENT DOCUMENTS

DE 202007019033 U1 4/2010

OTHER PUBLICATIONS

Vainikainen, et al. "Resonator-Based Analysis of the Combination of Mobile Handset Antenna and Chassis" IEEE Transactions on Antennas and Propagation, vol. 50, No. 10, Oct. 2002. 12 Pages.
Aberle, et al. "Reconfigurable Antennas for Portable Wireless Devices" IEEE Antennas and Propagation Magazine, vol. 45, No. 6, Dec. 2003. 7 Pages.
Jose, et al. "Experimental Investigations on Electronically Tunable Microstrip Antennas" Microwave and Optical Technology Letters, vol. 20, No. 3, Feb. 5, 1999. 4 Pages.

* cited by examiner

*Primary Examiner* — Hoang V Nguyen
(74) *Attorney, Agent, or Firm* — Eschweiler & Associates, LLC

(57) ABSTRACT

An antenna system includes a ground plane including at least one slot, a first antenna element coupled to a first portion of the ground plane, a second antenna element coupled to a second portion of the ground plane which is spaced apart from the first portion and a tuner configured to change the influence of the slot to a current flow through the ground plane from the first portion to the second portion.

22 Claims, 14 Drawing Sheets

ANTENNA SYSTEM, METHOD AND MOBILE COMMUNICATION DEVICE

FIELD

The present invention relates to an antenna system, a method to be performed with the antenna system and a mobile communication device.

BACKGROUND

The current trend in mobile phone industrial design favors internal antennas, where the antenna is not visible to the customer. The phones include more radio transceivers, for example tri-band UMTS, Quad-band GSM, BT, WLAN, GPS, FM radio, DVB-H, all requiring their own antenna. At the same time there should be room for all the chips on the PCB together with larger display, camera, memory cards, etc., without making the phone appear large and clumsy. Fitting all those antennas into a phone is quite a challenge. The three key parameters when designing mobile phone antennas are bandwidth, size and efficiency. The facts are that a limitation exists with respect to the maximum bandwidth and efficiency obtainable, depending on the realistic size of the antenna. Basically, the minimum bandwidth is determined by the system specification, for example GSM and UMTS, and the efficiency by the total radiated power (TRP) and total isotropic sensitivity (TIS) requirements setup by, for example, CTIA, 3GPP, and mobile operators. The overall size is given by the industrial design. In a standard, non-tunable antenna design it is common to increase the size of the antenna to a level where the requirements for minimum bandwidth and efficiency can be achieved. However, this puts limits on the industrial design and alternatives are desirable.

One approach is to use tunable antennas where the frequency band can be tuned within a system or between bands of different communication systems. In this conventional approach, the antenna only covers a narrow band instantaneously, and the total antenna volume or the number of antennas can be reduced and the selectivity is increased. This conventional approach is well known, but has some limitations in practice.

In a standard antenna design, it is common to increase the size of the antenna to a level where the requirements for minimum bandwidth and efficiency can be achieved and accept the limitations it puts on the industrial design. It is also common to implement a series of decoupling techniques. However, a disadvantage is that these techniques are limited by the physical dimensions of the ground plane.

It is well known that at lower frequencies the mobile phone chassis acts as the main radiator. In fact, the length and the width of the chassis determine univocally the dipole mode of the chassis. The radiating mechanism can be seen as a combination of the antenna and the resonator chassis equivalent resonator forming a system of coupled resonators (as described in Vainikainen, P.; Ollikainen, J.; Kivekas, O.; Kelander, K.; "Resonator-based analysis of the combination of mobile handset antenna and chassis," Antennas and Propagation, IEEE Transactions on, vol. 50, no. 10, pp. 1433-1444, October 2002). The optimum coupling between the antenna and the chassis happens when the antenna and the chassis resonate at the same resonance frequency. This has the effect of maximizing the impedance bandwidth and increasing the mutual coupling to additional radiators. When the chassis mode is away from the intended resonance frequency of the antenna, the impedance bandwidth will be narrower and the mutual coupling to additional radiators will be lower.

Prior art has always focused on tuning the antenna element itself, varying its electrical length in many different ways (as described in Vainikainen, P.; Ollikainen, J.; Kivekas, O.; Kelander, K.; "Resonator-based analysis of the combination of mobile handset antenna and chassis," Antennas and Propagation, IEEE Transactions on, vol. 50, no. 10, pp. 1433-1444, October 2002 and K. A. Jose, V. K. Varadan, and V. V. Varadan, Experimental investigations on electronically tunable microstrip antennas, Microw. Opt. Technol. Lett., vol. 20, no. 3, pp. 166169, February 1999).

SUMMARY

The present disclosure relates to an antenna system comprising a ground plane, a first antenna element, a second antenna element and a tuner. The ground plane comprises at least one slot. The first antenna element is coupled to a first portion of the ground plane. The second antenna element is coupled to a second portion of the ground plane which is spaced apart from the first portion. Furthermore, the tuner is configured to change the influence of the slot to a current flow through the ground plane from the first portion to the second portion.

Furthermore, the present disclosure relates to a mobile communication device comprising a chassis and an antenna system. The antenna system comprises a ground plane, a first antenna element, a second antenna element and a tuner. The ground plane is formed by at least a part of the chassis and comprises at least one slot. The first antenna element is coupled to a first portion of the ground plane. The second antenna element is coupled to a second portion of the ground plane which is spaced apart from the first portion. Furthermore, the tuner is configured to change the influence of the slot to a current flow through the ground plane from the first portion to the second portion.

Furthermore, the present disclosure relates to a method comprising providing a ground plane comprising at least one slot, providing a first antenna element coupled to a first portion of the ground plane, providing a second antenna element coupled to a second portion of the ground plane which is spaced apart from the first portion and changing the influence of the slot to a current flow through the ground plane from the first portion to the second portion.

BRIEF DESCRIPTION OF THE DRAWINGS

The present invention will be subsequently described taking reference to the enclosed figures in which.

DETAILED DESCRIPTION

Figure 1A:
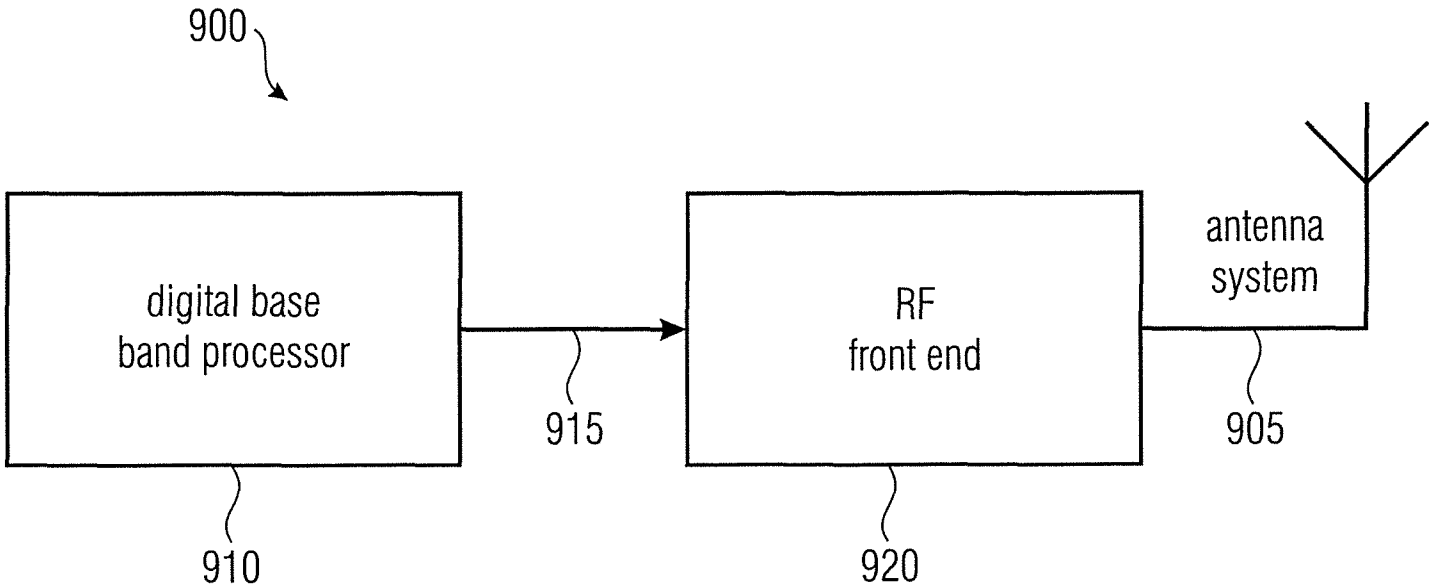
FIG. 1*a* shows a schematic diagram of an example mobile communication device.

FIG. 1*a* shows a schematic diagram of an example mobile communication device 900. As shown in FIG. 1*a*, the mobile communication device 900 comprises a digital base band processor 910, an RF front end 920 and an antenna system 905. The RF front end 920 is coupled between the antenna system 905 and the digital base band processor 910. For example, the digital base band processor 910 provides an RF input signal 915. In addition, the antenna system 905 is configured to relay an RF output signal provided by the RF front end 920. For example, the antenna system 905 shown in FIG. 1*a* may correspond to one of the antenna systems described herein.

The mobile communication device 900 may be a portable mobile communication device.

As an example, the mobile communication device can be configured to perform a voice and/or data communication (according to a mobile communication standard) with another (portable) communication device and/or a mobile communication base station. Such a mobile communication device may be, for example, a mobile handset such as a mobile phone (cell phone), a smart phone, a tablet PC, a broadband modem, a notebook or a laptop, as well as a router, switch, repeater or a PC. Furthermore, such a mobile communication device may be a mobile communication base station.

By having the example antenna system 905, it is possible to achieve a tunability of the chassis mode and control the impedance bandwidth and the isolation of the mobile communication device 900 adaptively.

Although in FIG. 1*a* the antenna system 905 is presented as part of the mobile communication device 900, the antenna system 905 may also be used in other devices.

In the following, different examples of such an antenna system will be described in more detail.

As already described before, conventional antenna systems have always focused on tuning the antenna element for adjusting their characteristics. The conventional antenna systems have disadvantages of the limitation on the industrial design, the practical limitations and the limitation by the physical dimensions of the ground plane. There exists a need to provide for an alternative manner for setting the characteristic of an antenna system avoiding such disadvantages.

Accordingly, instead of tuning the antenna element, the ground plane of the antenna system itself is tuned. In particular, this tuning can be realized if a ground plane comprising at least one slot is provided and if the influence of the slot to a current flow within the ground plane is changed, for example, by changing the slot impedance. In this way, it is possible to achieve a tunability of the ground plane mode or chassis mode and control the impedance bandwidth and the isolation of the antenna system or mobile communication device adaptively.

Figure 1B:
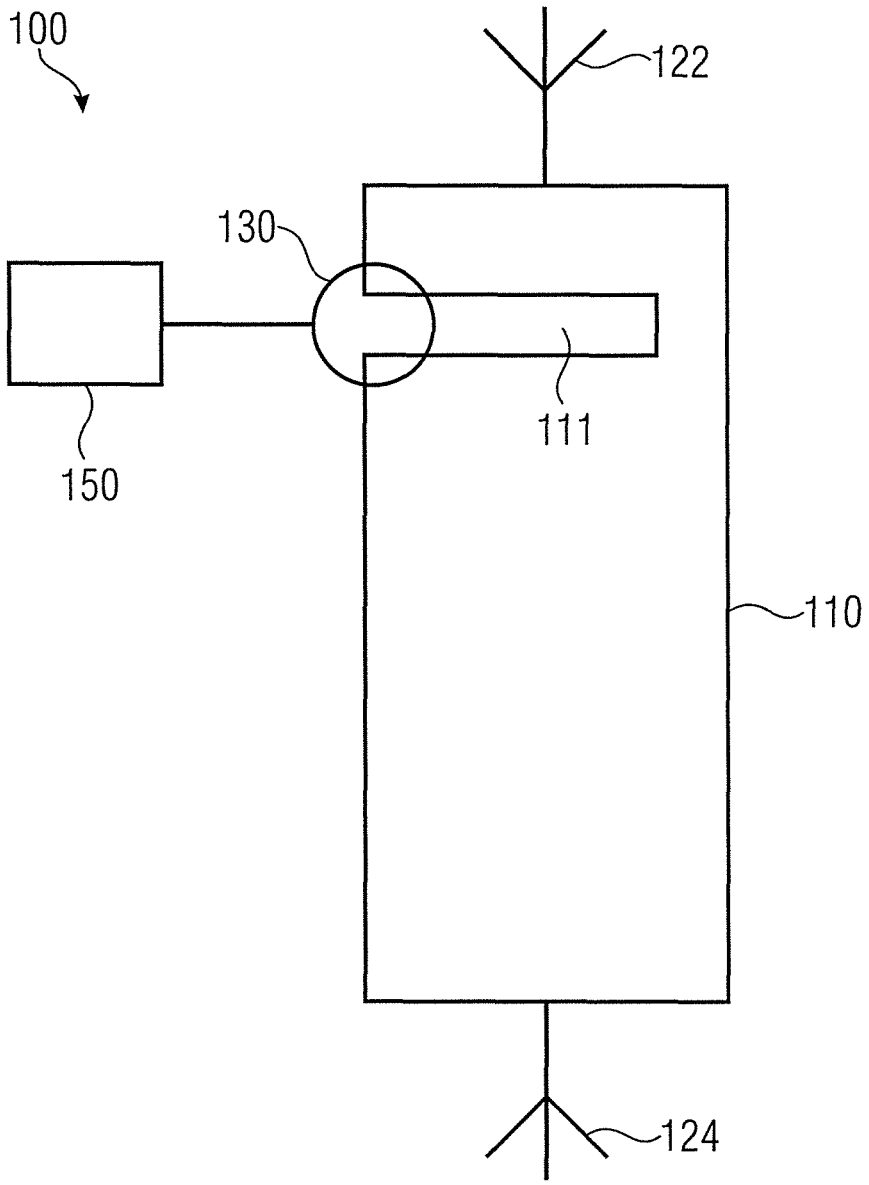
FIG. 1*b* shows a schematic diagram of an example antenna system.

FIG. 1*b* shows a schematic diagram of an example antenna system 100. As shown in FIG. 1*b*, the antenna system 100 comprises a ground plane 110, a first antenna element 122, a second antenna element 124 and a tuner 130. For example, the tuner 130 may be coupled to a tuner controller 150.

The ground plane 110 comprises at least one slot 111. The first antenna element 122 and the second antenna element 124 are coupled to the ground plane 110. Furthermore, the tuner 130 is configured to change the influence of the slot 111 on a current flow which can be formed within the ground plane 110. The tuner controller 150 is configured to control the tuner 130 by using a tuner control signal. For example, the tuner 130 can be controlled by the tuner controller 150 such that two different tuner states of the tuner 130 will be provided. The two different tuner states may correspond to a smaller (or negligible) and a larger (or maximum) influence of the slot 111 on the current flow. The maximum influence may, for example, be associated with a maximum bandwidth and efficiency.

The antenna system 100 of FIG. 1*b* may be implemented as part of a mobile communication device (e.g. the mobile communication device 800 shown in FIG. 8), wherein the ground plane is formed by at least a part of the chassis (e.g. chassis 810).

Figure 1C:
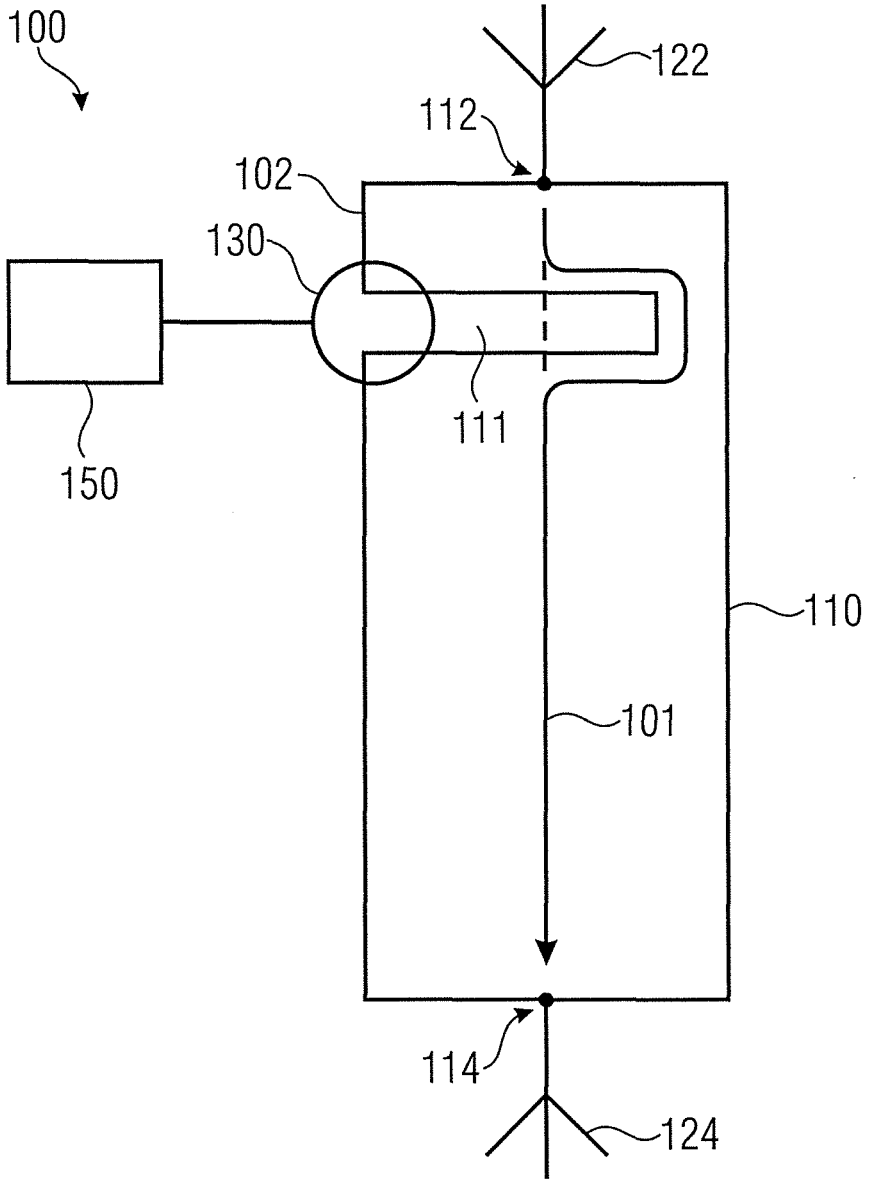
FIG. 1*c* shows a schematic diagram of the example antenna system shown in FIG. 1*b* for illustrating a current flow through its ground plane.

FIG. 1*c* shows a schematic diagram of the example antenna system 100 shown in FIG. 1*b* for illustrating a current flow 101 through its ground plane 110. As shown in FIG. 1*c*, the first antenna element 122 is coupled to a first portion 112 of the ground plane 110 and the second antenna element 124 is coupled to a second portion 114 of the ground plane 110 which is spaced apart from the first portion 112. Furthermore, the tuner 130 is configured to change the influence of the slot 111 on a current flow 101 through the ground plane 110 from the first portion 112 to the second portion 114.

Referring to FIG. 1*c*, the current flow 101 is depicted by an arrow pointing substantially from the first portion 112 to the second portion 114 of the ground plane 110. For example, the tuner 130 may be configured to provide a first and a second tuner state, wherein in the first tuner state the current flow 101 directly traverses the slot 111 (dashed line), and wherein in the second tuner state the current flow 101 substantially passes around the slot 111 (solid line).

Furthermore, the ground plane 110 of the antenna system 100 may be formed by a back plane of the chassis of a mobile communication device. The ground plane 110 is, for example, a metallic back plane of the chassis 810 of the mobile communication device 800 shown in FIG. 8.

In the antenna system 100 of FIG. 1*c*, the tuner 130 may, for example, be configured to change an impedance of the slot 111 to change a length of a current path covered by the current flow 101. In case the impedance is increased by the tuner 130, the length of the current path will effectively become longer, while in case the impedance is decreased by the tuner 130, the length of the current path will effectively become shorter. The shorter and longer lengths of the current path essentially correspond to shorter and longer electrical lengths of the ground plane 110 (or chassis 810). By providing the different electrical lengths of the ground plane or chassis, it is possible to effectively tune different properties of the antenna system such as the impedance bandwidth.

Referring to FIG. 1*c*, the first antenna element 122 and the second antenna element 124 may represent two antenna elements of the same or different type and of arbitrary shape. The different configurations of the antenna elements will be described later with reference to FIGS. 2*a* to 2*c*.

In addition, even though the first portion 112 and the second portion 114 to which the first antenna element 122 and the second antenna element 124 are coupled are indicated in FIG. 1*c* as being rather point-like, the first portion 112 and the second portion 114 may represent extended portions extending, for example, in parallel to a shorter side of the ground plane 110.

In the antenna system 100 of FIG. 1*c*, the slot 111 extends only partially through the ground plane 110.

In particular, the slot 111 can be directly adjacent to an edge 102 (longer side) of the ground plane 110.

Furthermore, the slot 111 may comprise a rectangular shape having a predefined area, wherein the predefined area is less than one quarter of an area (total area) of the ground plane 110. Therefore, the predefined area or slot area is typically relatively small as compared to the total area of the ground plane 110. This ensures that on the one hand, the desired tunability of the ground plane mode or chassis mode can be achieved, while on the other hand the influence of the slot to the current flow can be limited such that the ground plane mode or chassis mode can still reliably develop.

Figure 2A:
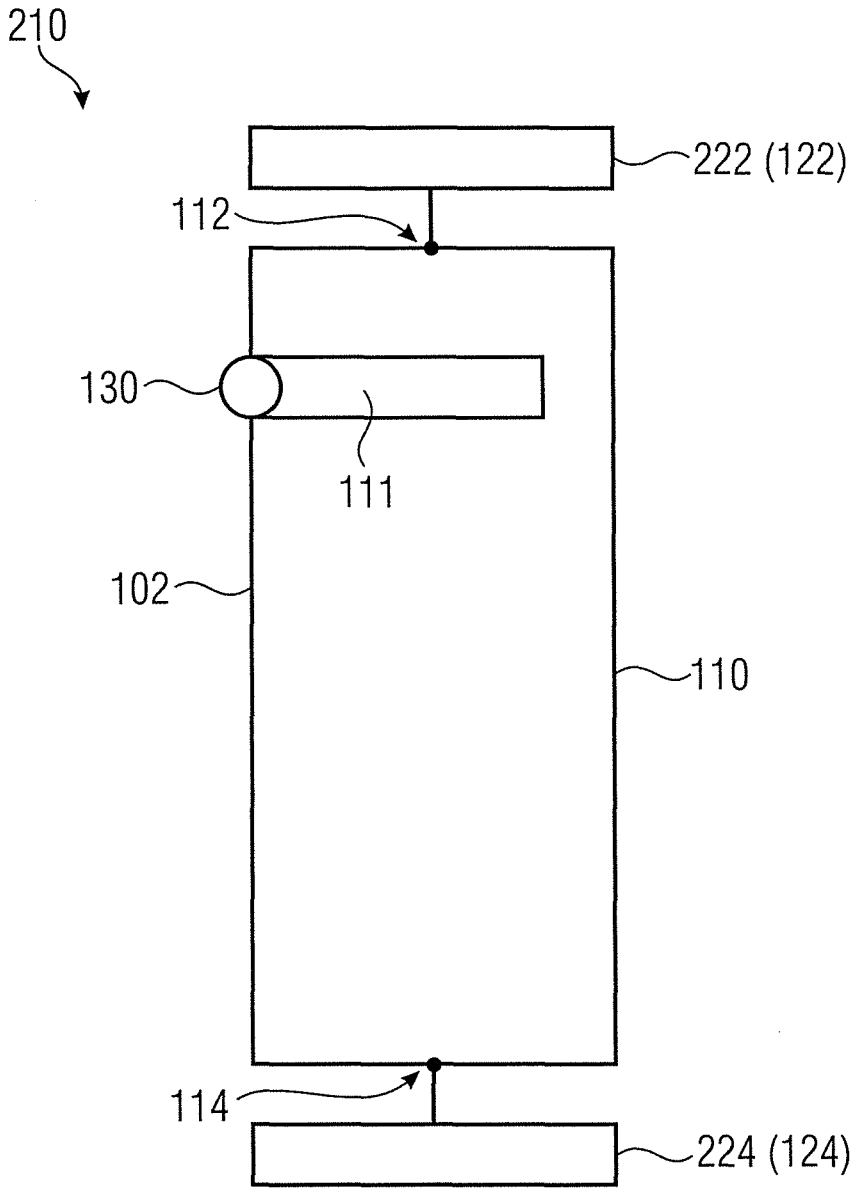
FIG. 2*a* shows a schematic diagram of an example antenna system comprising two coupling elements.

FIG. 2*a* shows a schematic diagram of an example antenna system 210 comprising two coupling elements 222, 224. The antenna system 210 shown in FIG. 2*a* differs from the antenna system 100 shown in FIG. 1*b* in that the first antenna element 122 and the second antenna element 124 are represented by coupling elements 222, 224, respectively. In the antenna system 210 of FIG. 2*a*, the coupling elements 222, 224 are directly coupled to the ground plane 110 by using an impedance matching circuit, wherein the coupling elements 222, 224 are non-self-resonating elements.

For example, the non-self-resonating coupling elements 222, 224 in the antenna system 210 of FIG. 2*a* may explicitly be implemented as described in Vainikainen, P.; Ollikainen, J.; Kivekas, O.; Kelander, K.; "Resonator-based analysis of the combination of mobile handset antenna and chassis," Antennas and Propagation, IEEE Transactions on, vol. 50, no. 10, pp. 1433-1444, October 2002.

In addition, the two coupling elements 222, 224 may be capacitively or inductively coupled to the ground plane 110 (or the first portion 112 and the second portion 114 thereof). In case of a capacitive coupling of the two coupling elements 222, 224, a capacitance and a suitable impedance matching circuit may be connected in series between the ground plane 110 and each of the two coupling elements 222, 224. In case of an inductive coupling of the two coupling elements 222, 224, an inductance and a suitable impedance matching circuit may be connected in series between the ground plane 110 and each of the two coupling elements 222, 224.

Figure 2B:
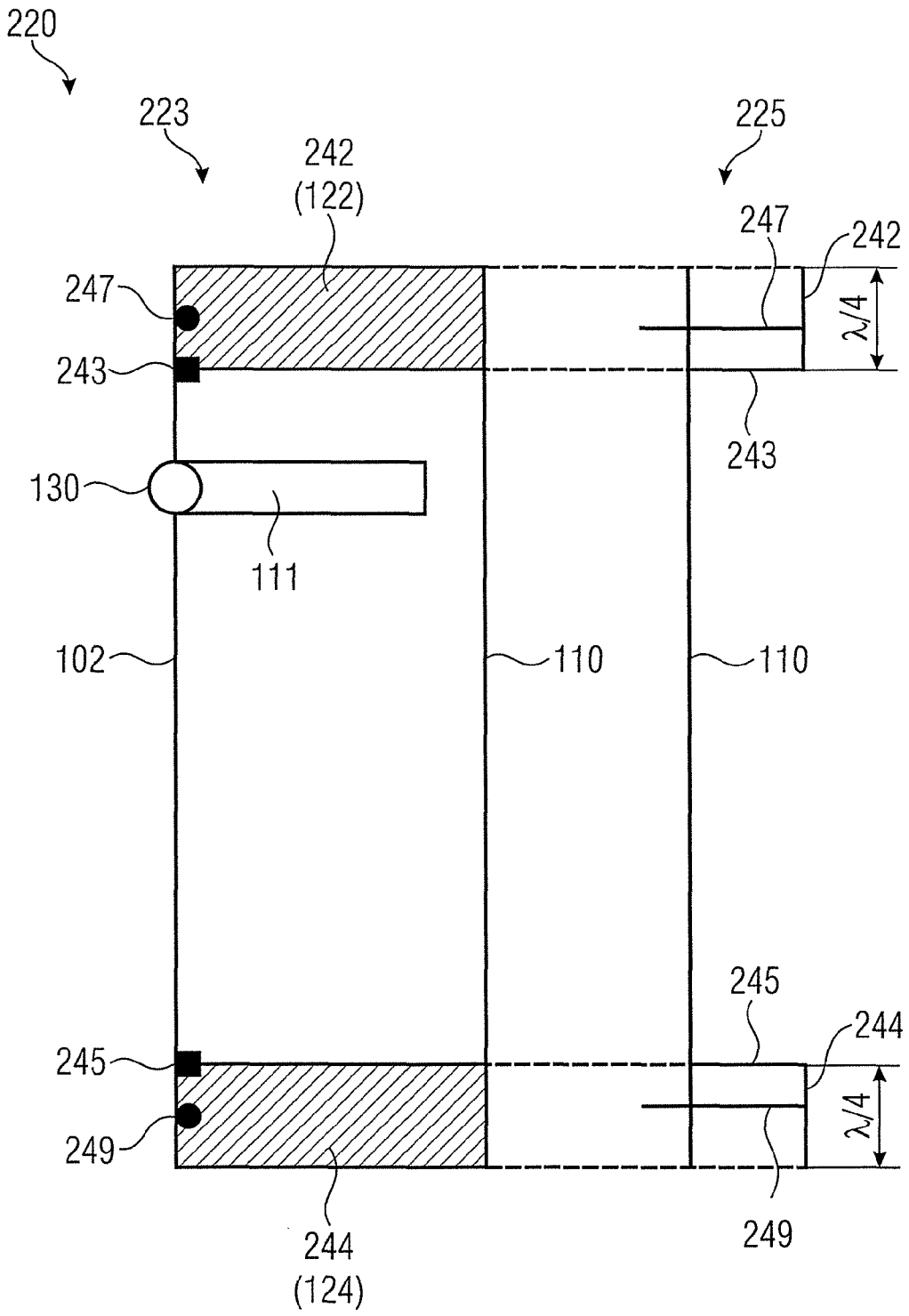
FIG. 2*b* shows a schematic diagram of an example antenna system comprising two planar inverted F-shaped antenna elements.

FIG. 2*b* shows a schematic diagram of an exemplary antenna system 220 comprising two planar inverted F-shaped antenna elements 242, 244. The antenna system 220 shown in FIG. 2*b* differs from the antenna system 100 shown in FIG. 1*b* in that the first antenna element 122 and the second antenna element 124 are planar inverted F-shaped antenna (PIFA) elements, wherein the planar inverted F-shaped antenna elements are self-resonating elements.

In FIG. 2*b*, the antenna system 220 is exemplarily depicted in two different views 223 (top view) and 225 (side view).

In the side view 225 of FIG. 2*b* it is depicted that the two planar inverted F-shaped antenna elements 242, 244 are short-circuited to the ground plane 110 by two corresponding short-circuit connections 243, 245. In addition, the side view 225 of FIG. 2*b* shows two respective feeding lines 247, 249 for feeding the corresponding planar inverted F-shaped antenna elements 242, 244.

Referring to the antenna system 220 of FIG. 2*b*, the two planar inverted F-shaped antenna elements 242, 244 are aligned with respect to the ground plane 110 such that in the top view 223 of FIG. 2*b* the two planar inverted F-shaped antenna elements 242, 244 and the ground plane 110 overlap. The overlap region is indicated in FIG. 2*b* by the dashed lines. In addition, the feeding lines 247, 249 and the short-circuit connections 243, 245 are also indicated in the top view of FIG. 2*b*.

For example, the two planar inverted F-shaped antenna elements 242, 244 may be implemented as $\lambda/4$ patch elements (having a length of one quarter of the wavelength at the resonant frequency).

In comparison to the antenna system 210 shown in FIG. 2*a*, the antenna system 220 shown in FIG. 2*b* enables a rather simple and efficient electromagnetic coupling of the two planar inverted F-shaped antenna elements 242, 244 to the ground plane 110, without requiring a specific coupling circuit or impedance matching circuit in between.

Figure 2C:
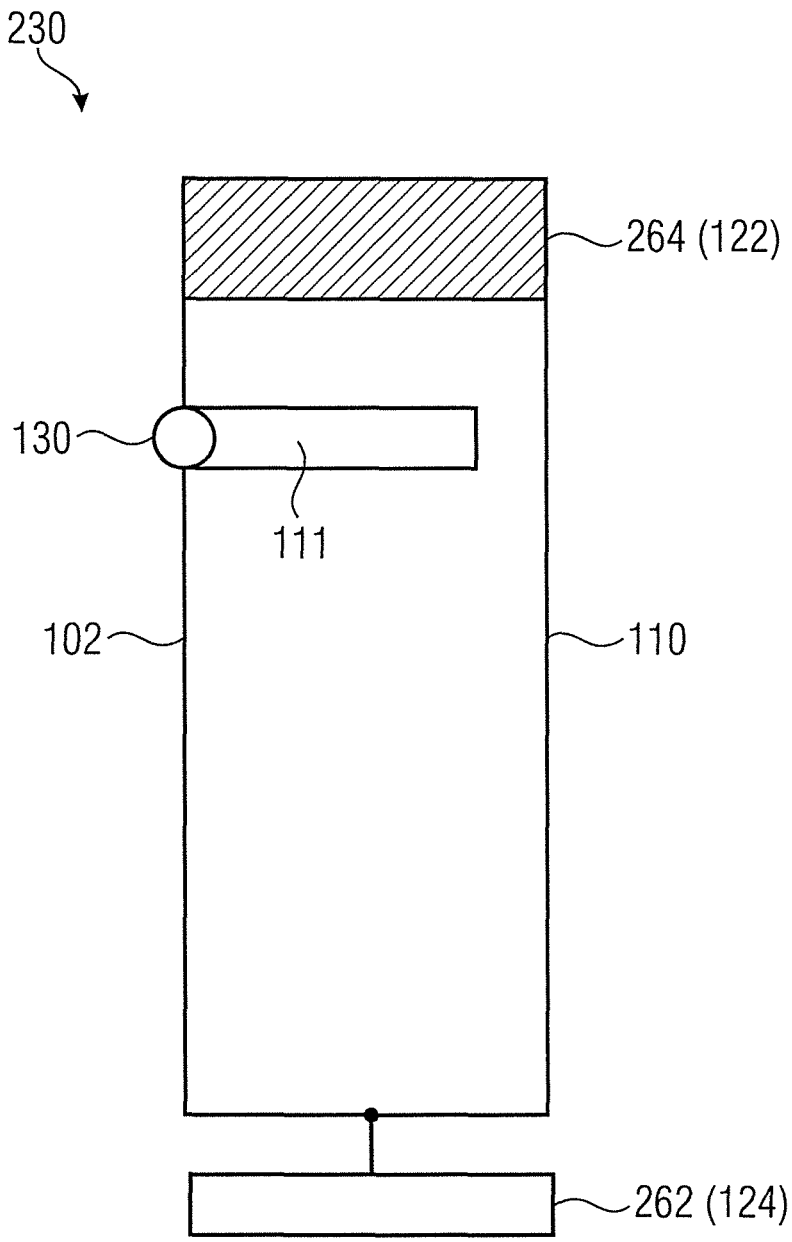
FIG. 2*c* shows a schematic diagram of an example antenna system comprising a coupling element and a planar inverted F-shaped antenna element.

FIG. 2*c* shows a schematic diagram of an exemplary antenna system 230 comprising a coupling element 262 and a planar inverted F-shaped antenna element 264. The antenna system 230 shown in FIG. 2*c* differs from the antenna system 210 shown in FIG. 2*a* in that the first antenna element 122 is a self-resonating planar inverted F-shaped antenna element 264 and the second antenna element 124 is represented by a non-self-resonating coupling element 262 which is directly coupled to the ground plane 110 by using an impedance matching circuit.

For example, the self-resonating planar inverted F-shaped antenna element 264 may be implemented as a $\lambda/4$ patch element (such as described in FIG. 2*b*). In addition, the non-self-resonating coupling element 262 may explicitly be implemented as described in Vainikainen, P.; Ollikainen, J.; Kivekas, O.; Kelander, K.; "Resonator-based analysis of the combination of mobile handset antenna and chassis," Antennas and Propagation, IEEE Transactions on, vol. 50, no. 10, pp. 1433-1444, October 2002.

By providing the different antenna systems 210, 220, 230 shown in FIGS. 2*a* to 2*c*, it is possible to achieve a more flexible and efficient coupling of the first antenna element 122 and the second antenna element 124 to the ground plane 110 (or to the first portion 112 and the second portion 114 thereof). This coupling is essentially provided from two different sides (shorter sides) of the ground plane 110 such that a relatively large current flow through the ground plane 110 from the first portion 112 to the second portion 114 can be obtained. By the provision of the relatively large current flow in the ground plane 110, it is possible to obtain a reliable ground plane mode or chassis mode of the antenna system.

Figure 3B:
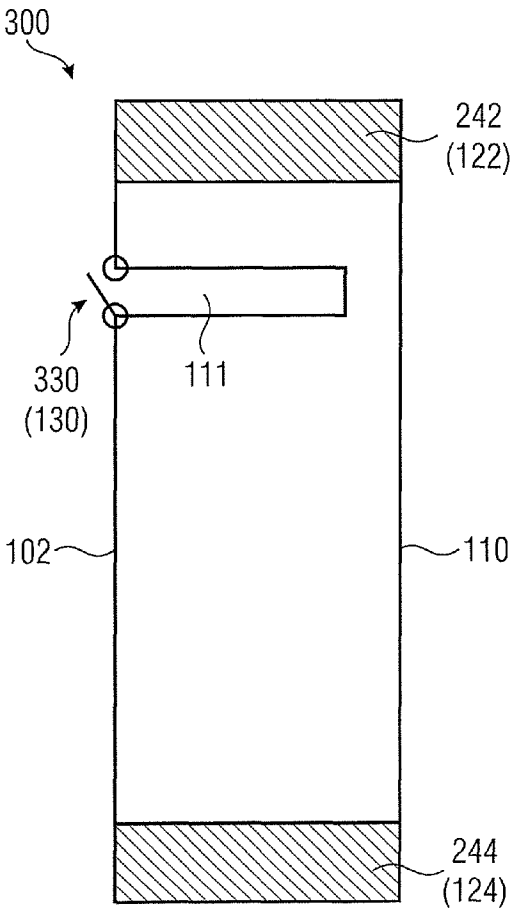
FIGS. 3*a* and 3*b* show schematic diagrams of an example antenna system comprising a tuner for providing a first and a second tuner state.
Figure 3A:
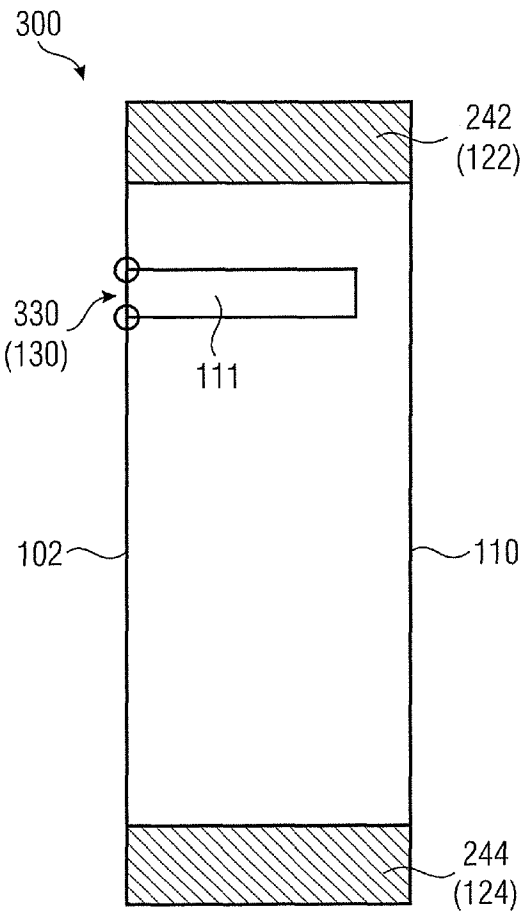

FIGS. 3*a* and 3*b* show schematic diagrams of an exemplary antenna system 300 comprising a tuner 330 for providing a first and a second tuner state. In FIG. 3*a*, the first tuner state of the tuner 330 is schematically depicted, while in FIG. 3*b* the second tuner state of the tuner 330 is schematically depicted. The antenna system 300 shown in FIG. 3*a* essentially corresponds to the antenna system 220 shown in FIG. 2*b* comprising the two planar inverted F-shaped antenna elements 242, 244. However, as schematically depicted in FIGS. 3*a* and 3*b*, the tuner 330 of the antenna system 300 may be configured as a switch for switching between a closed state (FIG. 3*a*) and an open state (FIG. 3*b*).

For example, the tuner 330 or switch of the antenna system 300 may be configured to provide a first tuner state corresponding to a closed circuit (FIG. 3*a*) and a second tuner state corresponding to an open circuit (FIG. 3*b*), wherein in the second tuner state a resonant frequency of the ground plane 110 is reduced when compared to the resonant frequency of the ground plane 110 in the first tuner state. The reduction of the resonant frequency of the ground plane 110 in the second tuner state is essentially due to the fact that the length of the current path covered by the current flow through the ground plane 110 will effectively become larger.

Figure 4:
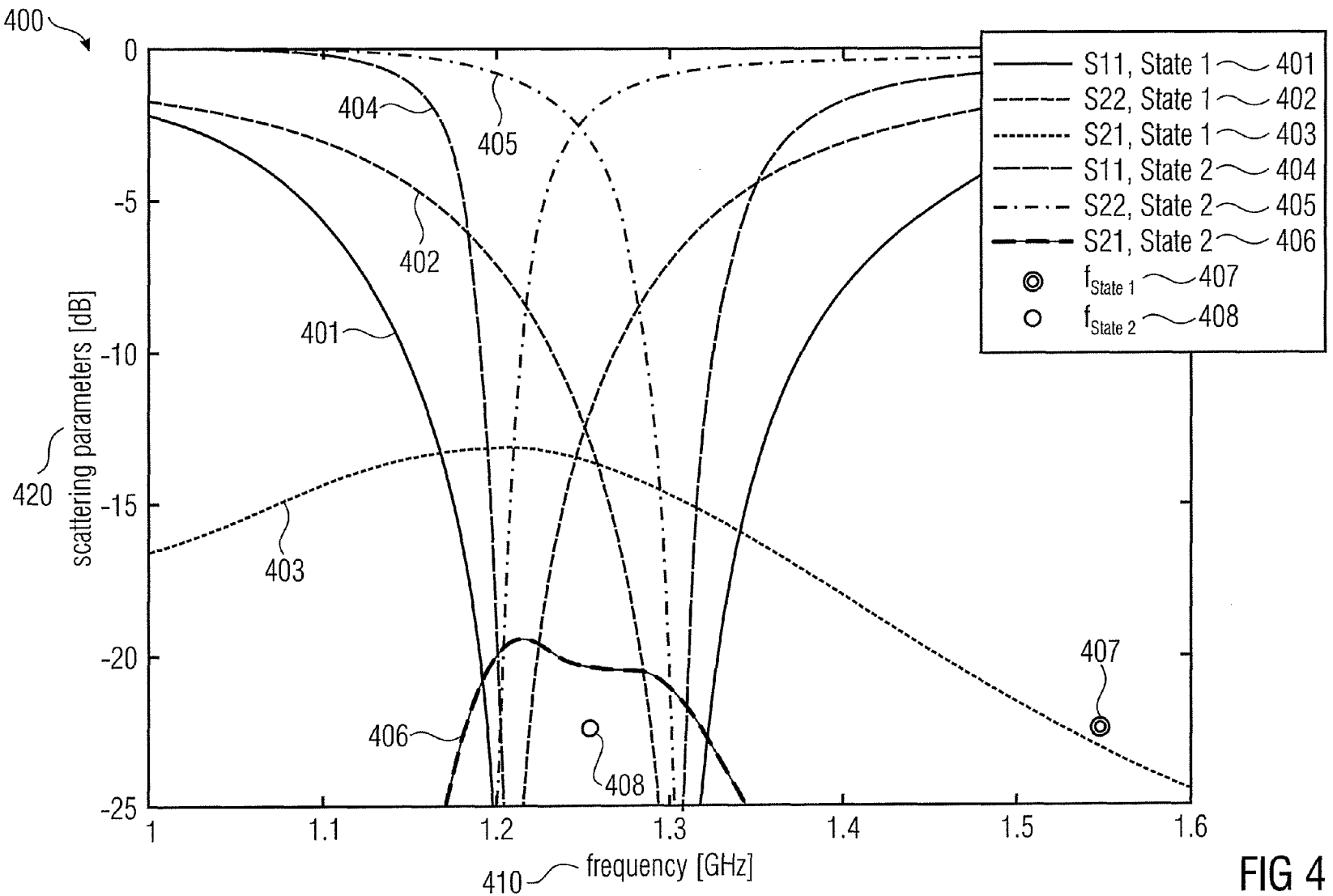
FIG. 4 shows a graph of exemplary scattering parameters as a function of frequency.

FIG. 4 shows a graph 400 of exemplary scattering parameters 420 as a function of frequency 410. In the graph 400 of FIG. 4, the scattering parameters 420 are given in dB, while the frequency 410 is given in GHz. In addition, a range of the scattering parameters 420 on the ordinate scales from 0 to −25 dB, while a range of the frequency 410 on the abscissa scales from 1 to 1.6 GHz. The exemplary scattering parameters 420 of the graph 400 shown in FIG. 4 may be obtained from the antenna system 300 shown in FIGS. 3*a* and 3*b*. Basically, the exemplary scattering parameters 420 can be used to describe the antenna system 300 of FIGS. 3*a* and 3*b* for the two different tuner states provided by the tuner 330. In the graph 400 of FIG. 4, different curves 401, 402, 403, 404, 405 and 406 for the scattering parameters 420 as the function of the frequency 410 are exemplarily depicted. In addition, two points 407, 408 in the graph 400 of FIG. 4 are exemplarily shown. In particular, the curve 401 corresponds to the S-parameter S11 in the first tuner state, the curve 402 corresponds to the S-parameter S22 in the first tuner state, the curve 403 corresponds to the S-parameter S21 in the first tuner state, the curve 404 corresponds to the S-parameter S11 in the second tuner state, the curve 405 corresponds to the S-parameter S22 in the second tuner state and the curve 406 corresponds to the S-parameter S21 in the second tuner state. In addition, the point 407 corresponds to the resonant frequency in the first tuner state, while the point 408 corresponds to the resonant frequency in the second tuner state.

In general, the scattering parameters or S-parameters describe the reflection properties of the antenna system. In particular, the S-parameter S11 describes a reflection at the input port of the antenna system (e.g. at the planar inverted F-shaped antenna element 242), the S-parameter S22 describes a reflection at the output port of the antenna system (e.g. at the planar inverted F-shaped antenna element 244), while the S-parameter S21 describes a forward gain between the input port and the output port (e.g., from the planar inverted F-shaped antenna element 242 to the planar inverted F-shaped antenna element 244). It can be seen from the graph 400 of FIG. 4 that when switching from the first tuner state to the second tuner state, the frequency bandwidth corresponding to the S-parameter S11, 401, 404, essentially decreases, the frequency bandwidth corresponding to the S-parameter S22, 402, 405, essentially decreases, and the frequency bandwidth corresponding to the S-parameter S21, 403, 406, decreases as well.

Furthermore, it can be observed from the graph 400 of FIG. 4 that when switching from the first tuner state to the second tuner state, the resonant frequency of the ground plane will essentially be reduced. For example, the resonant frequency 407 of the ground plane in the first tuner state is approximately 1.55 GHz, while the resonant frequency 408 of the ground plane in the second tuner state is approximately 1.25 GHz. Therefore, by switching between the first tuner state and the second tuner state, the resonant frequency of the ground plane can significantly be reduced.

To summarize the previous figures, it has been described with reference to FIGS. 2*a* to 2*c* that by devising one or more slots to be hosted in the chassis controlled by a tuner, it is possible to dynamically change the length of the chassis itself. The tuner can be a variable capacitor or a switch, achieving the desired effect of chassis length modulation through its control signals. Two possible uses can be considered for the same tunable chassis mode operation. A first case considers the situation where the ground plane size is such that its natural resonance is higher than the one to be used as central frequency for a given standard. For example, if the chassis is 40×100 mm, it will have a natural resonance around 1.2 GHz, while the GSM 900 frequency bandwidth will be needed to be supported. The bandwidth can be increased without enlarging the antenna of the chassis, at the expense of a decrease in the isolation level. A second case considers that the mutual coupling can be decreased without modifying the antenna, at the expense of a narrower bandwidth. In the previous description, only an example of the first case was given, as the second case is a dual configuration.

Referring to FIGS. 3*a* and 3*b*, the two states of the tuner were described in one example. The first state essentially corresponds to the situation where the tuner is in the normal default state, not exhibiting any effect on the chassis, meaning the chassis effective length is unchanged. It can be seen like a short circuit that is connecting the two sides of the chassis, deselecting de facto the slot action. The second state essentially corresponds to the situation where the tuner is creating a barrier (open circuit) between the two sides of the slot, enabling the current to follow a longer path and thus tuning the electrical length of the chassis. The impact of the two states on the scattering parameters of the antenna system shown in FIGS. 3*a* and 3*b* were described with reference to FIG. 4 according to one example.

Figure 5A:
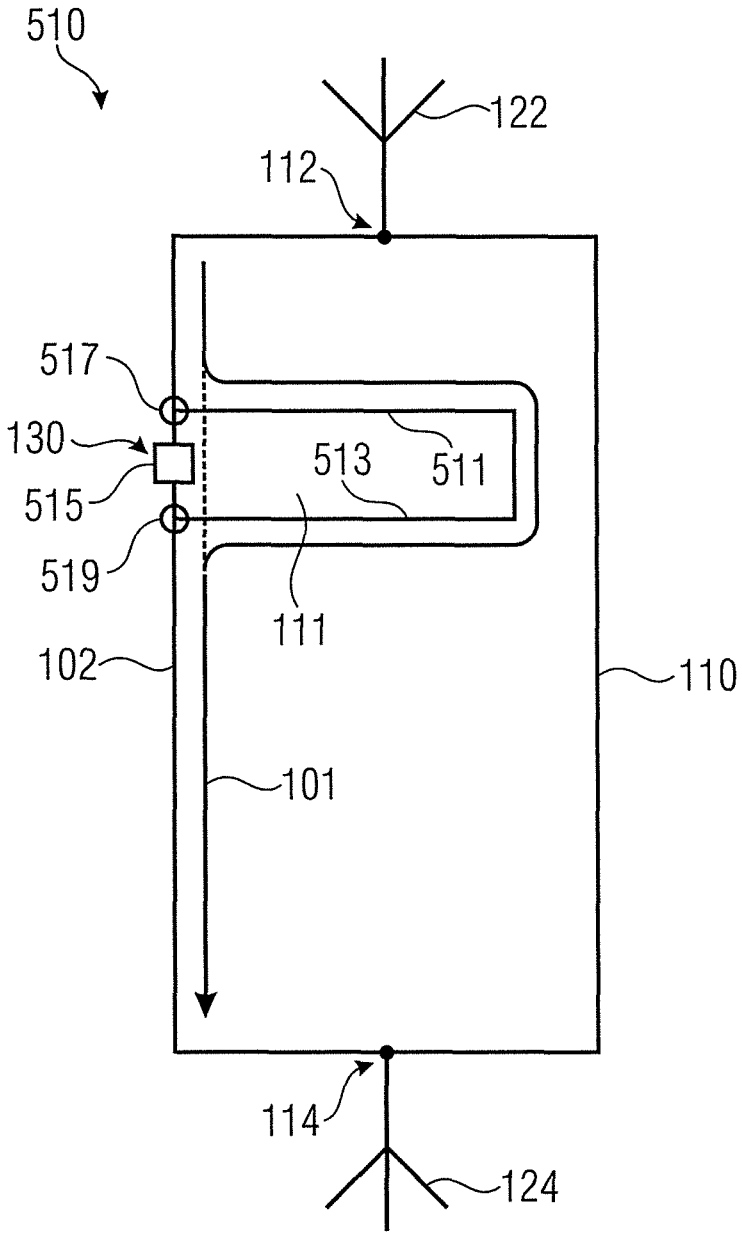
FIGS. 5*a* to 5*c* show different example implementations of one or more switches which may be implemented in the antenna system shown in FIG. 1*b;*
Figure 5B:
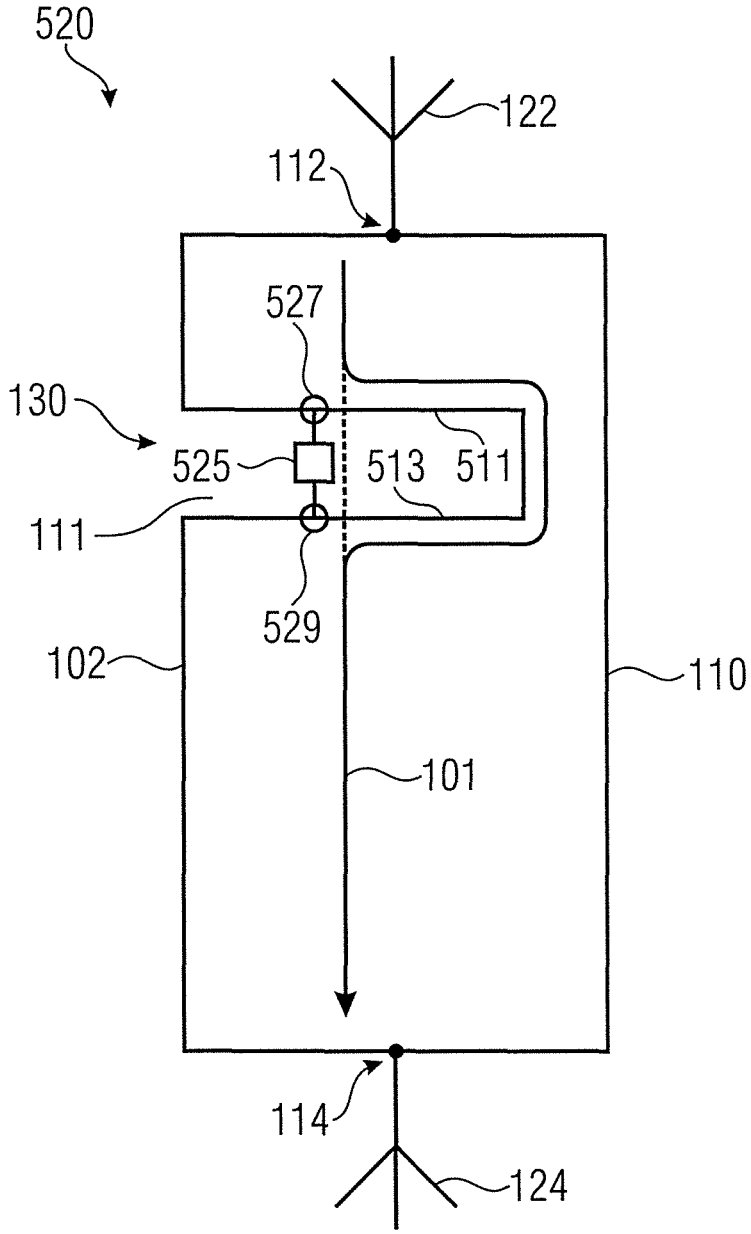
Figure 5C:
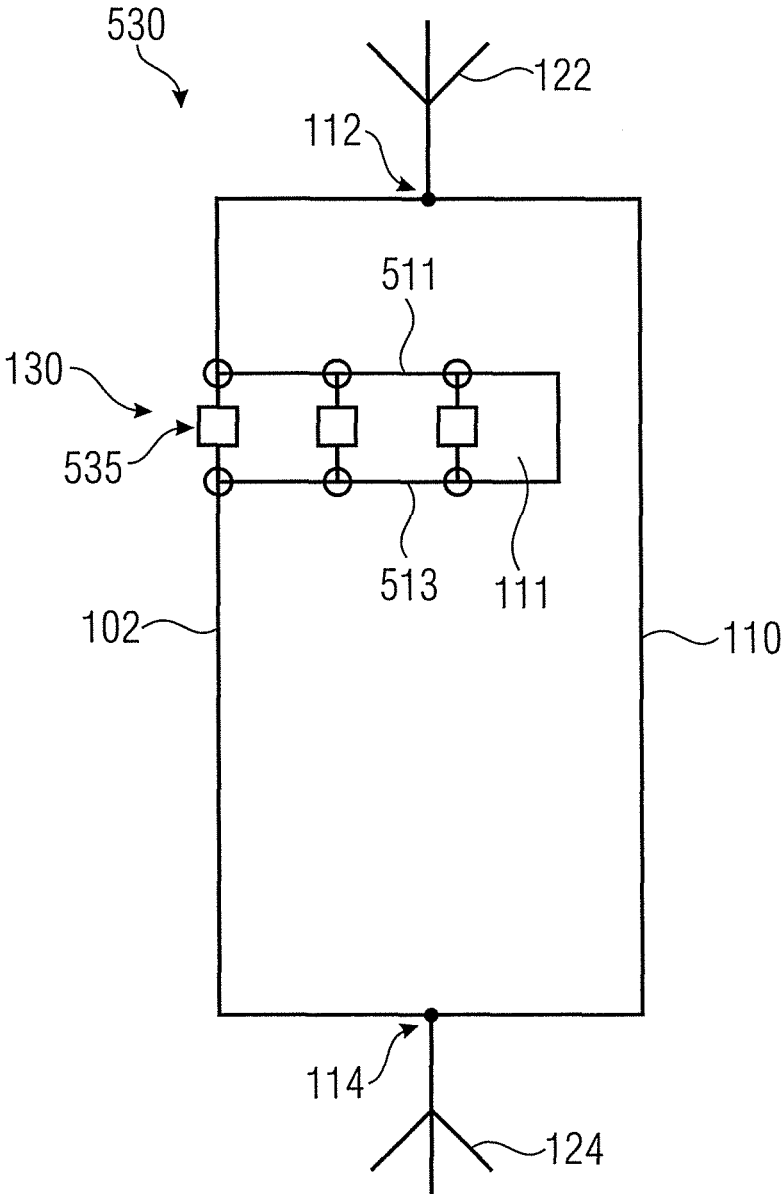

FIGS. 5*a* to 5*c* show different exemplary implementations 510, 520, 530 of one or more switches 515, 525, 535 which may be implemented in the antenna system 100 shown in FIG. 1*b*. In the different implementations 510, 520 of FIGS. 5*a* and 5*b*, the tuner 130 comprises a switch 515, 525 connected between two opposing sides 511, 513 of the slot 111, wherein the switch 515, 525 is configured to provide a first tuner state by shortening the two opposing sides 511, 513 of the slot 111 and a second tuner state by disconnecting the two opposing sides 511, 513 of the slot 111.

For example, referring to the implementation 510 of FIG. 5*a*, the switch 515 is connected between end points 517, 519 of the two opposing sides 511, 513 of the slot 111, wherein the end points 517, 519 are located at an edge 102 of the ground plane 110.

In addition, referring to the implementation 520 of FIG. 5*b*, the switch 525 is connected between midpoints 527, 529 of the two opposing sides 511, 513 of the slot 111.

In the different implementations 510, 520 of FIGS. 5*a* and 5*b*, the current flow 101 through the ground plane 110 from the first portion 112 to the second portion 114 is depicted for different examples. In case the first tuner state is provided by the switch 515, 525, the current flow 101 can essentially traverse the slot 111 as indicated by the dotted lines in FIGS. 5*a* and 5*b*. In case the second tuner state is provided by the switch 515, 525, the current flow 101 will substantially pass around the slot 111 as indicated by the solid lines shown in FIGS. 5*a* and 5*b*. By using the different implementations 510, 520, the influence of the slot to the current flow can essentially be different. For example, the length of the current path covered by the current flow in the first tuner state and the second tuner state in the implementation 510 may differ by approximately twice the length of one of the two opposing sides of the slot. In addition, the length of the current path covered by the current flow in the first tuner state and the second tuner state in the implementation 520 may differ by approximately twice the half of the length of one of the two opposing sides of the slot.

In the implementation 530 of FIG. 5*c*, the tuner 130 comprises a plurality of switches 535 connected between two opposing sides 511, 513 of the slot 111, wherein each of the plurality of switches 535 is configured to switch between a closed state and an open state. By using the plurality of switches 535 as shown in the implementation 530, the influence of the slot 111 to the current flow through the ground plane 110 from the first portion 112 to the second portion 114 can be changed in a more flexible way when compared to the implementations 510, 520. However, the provision of the plurality of switches 535 according to the implementation 530 is associated with a higher complexity of the antenna system.

Figure 6:
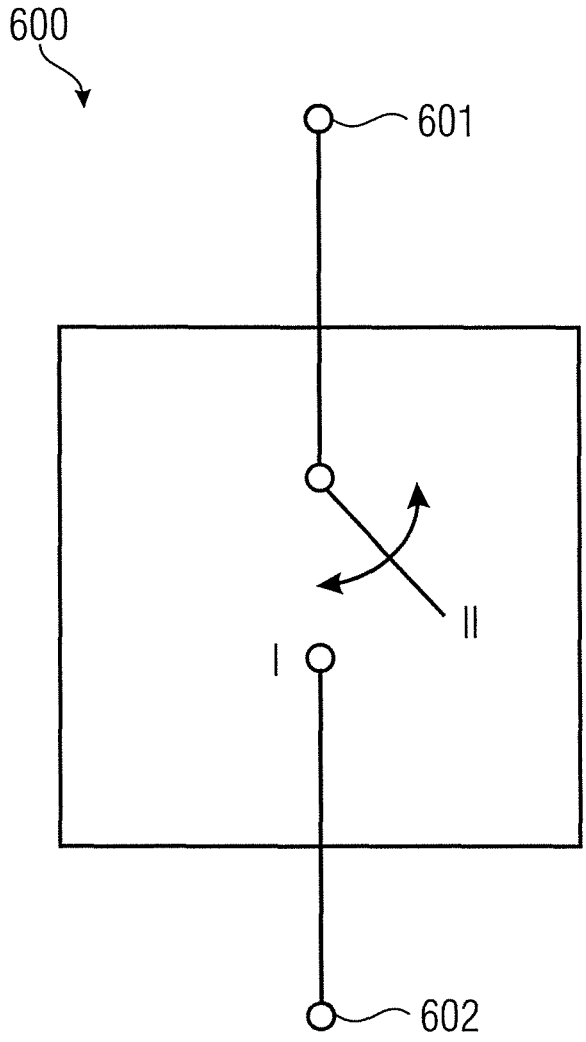
FIG. 6 shows an example implementation of a switch which may be implemented in the different example implementations shown in FIGS. 5*a* to 5*c;*

FIG. 6 shows an example implementation of a switch 600 which may be implemented in the different implementation examples 510, 520, 530 shown in FIGS. 5*a* to 5*c*. For example, the switch 600 shown in FIG. 6 may correspond to the one or more switches 515, 525, 535 shown in FIGS. 5*a* to 5*c*. As depicted in FIG. 6, the switch 600 comprises a first terminal 601 and a second terminal 602. These two terminals 601, 602 can be connected to the two opposing sides 511, 513 of the slot 111 according to the implementations 510, 520, 530. The switch 600 of FIG. 6 is configured to switch between a closed state (I) and an open state (II).

For example, the switch 600 shown in FIG. 6 may be a mechanical switch or a microelectromechanical systems (MEMS) switch.

In particular, the MEMS switch may comprise a substrate for traversing the slot of the ground plane, two contact elements for electrically connecting the ground plane on two opposing sides with respect to the slot and a capacitive switching element arranged on the substrate for providing the first state (closed state) and the second state (open state). The capacitive switching element of the MEMS switch may comprise a movable electrode which can be controlled by a control signal (e.g., a voltage signal) such that the two contact elements on the two opposing sides with respect to the slot will be connected via the movable electrode in the first state and disconnected in the second state.

Figure 7:
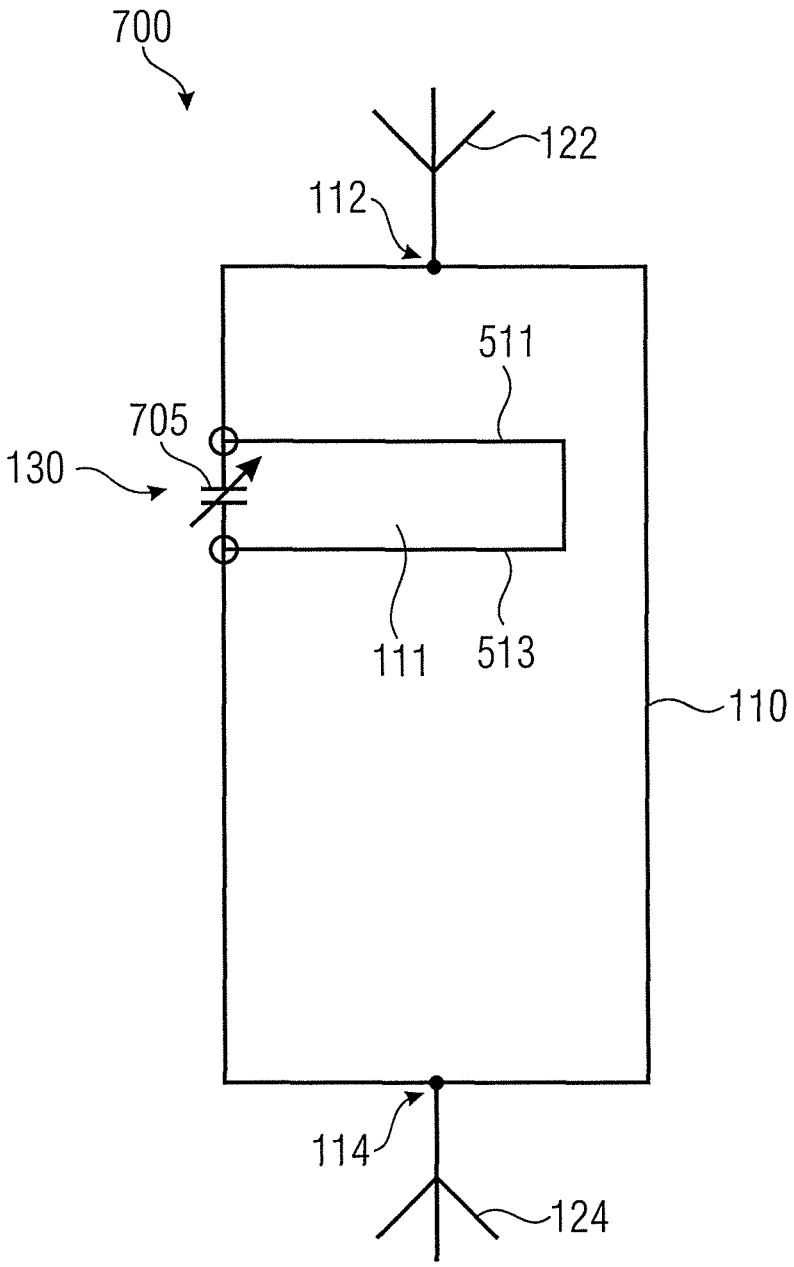
FIG. 7 shows a schematic diagram of an exemplary antenna system comprising a variable capacitor or variable impedance.

FIG. 7 shows a schematic diagram of an exemplary antenna system 700 comprising a variable capacitor (or variable impedance) 705 as a tuner 130. The antenna system 700 shown in FIG. 7 differs from the antenna system 100 shown in FIG. 1*b* in that the tuner 130 comprises a variable capacitor or variable impedance 705 connected between two opposing sides 511, 513 of the slot 111, wherein the variable capacitor or variable impedance 705 is configured to continuously change a capacitance or impedance thereof. By continuously changing the capacitance or impedance of the variable capacitor or variable impedance 705, it is possible to dynamically change the influence of the slot 111 to the current flow through the ground plane 110 from the first portion 112 to the second portion 114. The dynamic change of the influence of the slot to the current flow has the consequence that key parameters such as the impedance bandwidth of the antenna system can continuously be changed. This also provides the tunability of the ground plane mode or chassis mode of the antenna system for use in practical applications.

Figure 8:
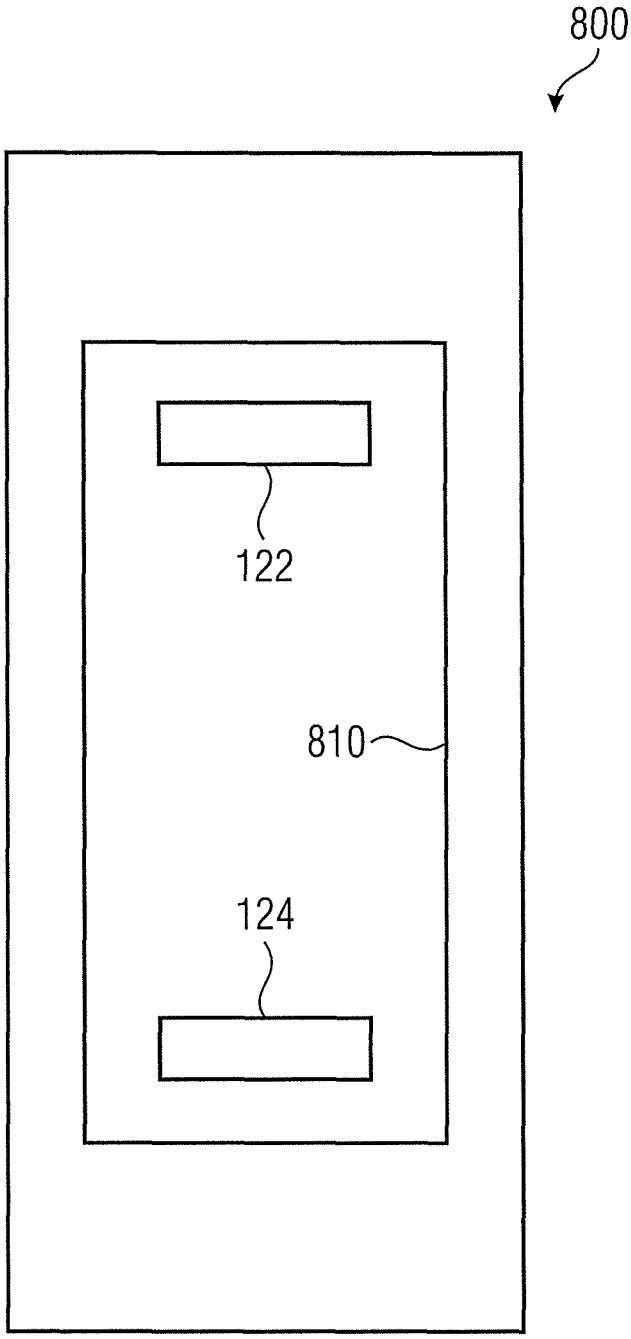
FIG. 8 shows a schematic diagram of an example mobile communication device comprising a chassis.

FIG. 8 shows a schematic diagram of an example mobile communication device 800 comprising a chassis 810. The mobile communication device 800 shown in FIG. 8 may comprise one of the antenna systems described herein. The antenna system of the mobile communication device 800 comprises the first antenna element 122 and the second antenna element 124.

For example, the chassis 810 may be formed by at least a part of a PCB (printed circuit board) of the mobile communication device 800. In addition, the chassis 810 may be formed by at least a part of a housing (e.g. the outer metallic part) of the mobile communication device 800. In particular, the chassis 810 may be a metallic part which acts as a ground for the mobile communication device 800.

Referring again to the implementation 510 of FIG. 5*a*, the antenna system may comprise the following features. For example, the antenna system comprises a ground plane 110, a first antenna element 122, a second antenna element 124 and a tuner 130. The ground plane 110 comprises at least one slot 111. The first antenna element 122 is coupled to a first portion 112 of the ground plane 110. The second antenna element 124 is coupled to a second portion 114 of the ground plane 110 which is spaced apart from the first portion 112. Furthermore, the tuner 130 is configured to change the influence of the slot 111 to a current flow 101 through the ground plane 110 from the first portion 112 to the second portion 114.

For example, the slot 111 comprises two opposing sides 511, 513 extending in parallel to each other, wherein the two opposing sides 511, 513 are arranged substantially perpendicular to a connecting line between the first portion 112 and the second portion 114.

In addition, the tuner 130 comprises a switch 515 or a variable impedance connected between end points 517, 519 of the two opposing sides 511, 513 of the slot 111, wherein the end points 517, 519 are located at an edge 102 of the ground plane 110.

As already described before, the tuner 130 may be configured to change an impedance of the slot 111 to change a length of a current path covered by the current flow 101.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some examples, some one or more of the most important method steps may be executed by such an apparatus.

Although each claim only refers back to one single claim, the disclosure also covers any conceivable combination of claims.

Instead of improving the antenna efficiency by increasing the physical size, the present antenna system uses a ground plane having a slot (or a segmented ground plane) that allows the tunability of the chassis mode. It allows to electrically enlarge the chassis dimensions and to control the level of isolation without having effects on the handset total dimensions.

Furthermore, instead of improving the antenna efficiency by increasing the physical size, the present antenna system uses a small antenna with the advantages it has for the industrial design. By using the ground plane having the slot or the segmented ground plane, it is possible to achieve tunability of the chassis mode and control the impedance bandwidth and the isolation adaptively.

The better performance of the presented antenna system can be obtained by focusing on tuning of the chassis mode, taking advantage of the aforementioned coupling phenomena. This can essentially be achieved by varying the electrical length of the chassis depending on the needs.

What is claimed is:

1. A mobile communication device, comprising:

a chassis; and an antenna system, comprising:

a ground plane formed by at least a part of the chassis and comprising at least one slot;

a first antenna element coupled to a first portion of the ground plane;

a second antenna element coupled to a second portion of the ground plane which is spaced apart from the first portion; and a tuner configured to change an influence of the slot to a current flow through the ground plane from the first portion to the second portion.

2. The mobile communication device according to claim 1, wherein the tuner is configured to change an impedance of the slot to change a length of a current path covered by the current flow.

3. The mobile communication device according to claim 1, wherein the slot extends only partially through the ground plane.

4. The mobile communication device according to claim 1, wherein the slot is directly adjacent to an edge of the ground plane.

5. The mobile communication device according to claim 1, wherein the slot comprises a rectangular shape having a predefined area, wherein the predefined area is less than one quarter of an area of the ground plane.

6. The mobile communication device according to claim 1, wherein the tuner is configured to provide a first tuner state corresponding to a closed circuit and a second tuner state corresponding to an open circuit, wherein in the second tuner state a resonant frequency of the ground plane is reduced when compared to a resonant frequency of the ground plane in the first tuner state.

7. The mobile communication device according to claim 1, wherein the tuner comprises a switch connected between two opposing sides of the slot, wherein the switch is configured to provide a first tuner state by shorting the two opposing sides of the slot and a second tuner state by disconnecting the two opposing sides of the slot.

8. The mobile communication device according to claim 7, wherein the switch is connected between end points of the two opposing sides of the slot, wherein the end points are located at an edge of the ground plane.

9. The mobile communication device according to claim 7, wherein the switch is connected between midpoints of the two opposing sides of the slot.

10. The mobile communication device according to claim 1, wherein the tuner comprises a plurality of switches connected between two opposing sides of the slot, wherein each of the plurality of switches is configured to switch between a closed state and an open state.

11. The mobile communication device according to claim 1, wherein the tuner comprises a variable impedance connected between two opposing sides of the slot, wherein the variable impedance is configured to change an impedance thereof in a continuous fashion.

12. The mobile communication device according to claim 1, wherein the tuner comprises a variable capacitor connected between two opposing sides of the slot, wherein the variable capacitor is configured to change a capacitance thereof in a continuous fashion.

13. The mobile communication device according to claim 1, wherein the first antenna element and the second antenna element are represented by coupling elements, wherein the coupling elements are directly coupled to the ground plane by using an impedance matching circuit, wherein the coupling elements are non-self-resonating elements.

14. The mobile communication device according to claim 1, wherein the first antenna element and the second antenna element are planar inverted F-shaped antenna elements, wherein the planar inverted F-shaped antenna elements are self-resonating elements.

15. The mobile communication device according to claim 1, wherein the first antenna element is a self-resonating planar inverted F-shaped antenna element and the second antenna element is represented by a non-self-resonating coupling element which is directly coupled to the ground plane by using an impedance matching circuit.

16. The mobile communication device according to claim 1, further comprising a tuner controller configured to control the tuner by using a tuner control signal.

17. The mobile communication device according to claim 1, wherein the ground plane is formed by a back plane of the chassis.

18. A method, comprising:

providing a ground plane formed by at least a part of a chassis of a mobile communication device, wherein the ground plane comprises at least one slot;

providing a first antenna element coupled to a first portion of the ground plane;

providing a second antenna element coupled to a second portion of the ground plane which is spaced apart from the first portion; and changing an influence of the slot to a current flow through the ground plane from the first portion to the second portion.

19. The method according to claim 18, wherein changing the influence of the slot to the current flow comprises changing an impedance of the slot to change a length of a current path covered by the current flow.

20. A mobile communication device, comprising:

a chassis; and an antenna system, comprising:

a ground plane formed by at least a part of the chassis and comprising at least one slot;

a first antenna element coupled to a first portion of the ground plane;

a second antenna element coupled to a second portion of the ground plane which is spaced apart from the first portion; and a tuner configured to change an influence of the slot to a current flow through the ground plane from the first portion to the second portion;

wherein the slot comprises two opposing sides extending in parallel to each other, wherein the two opposing sides of the slot are arranged substantially perpendicular to a connecting line between the first portion and the second portion of the ground plane;

wherein the tuner comprises a switch or a variable impedance connected between end points of the two opposing sides of the slot, wherein the end points are located at an edge of the ground plane.

21. The mobile communication device according to claim 20, wherein the tuner is configured to change an impedance of the slot to change a length of a current path covered by the current flow.

22. A mobile communication device, comprising:

a chassis; and an antenna system, comprising:

a ground plane formed by at least a part of the chassis and comprising at least one slot;

a first antenna element coupled to a first portion of the ground plane;

a second antenna element coupled to a second portion of the ground plane which is spaced apart from the first portion;

a tuner configured to change an influence of the slot to a current flow through the ground plane from the first portion to the second portion;

an RF front end; and a digital base band processor;

wherein the RF front end is coupled between the antenna system and the digital base band processor.

* * * * *